United States Patent [19]

Nitzki

[11] 3,988,994

[45] Nov. 2, 1976

[54] CATAMARAN

[75] Inventor: Leopold Nitzki, Bremen, Germany

[73] Assignee: Aktiengesellschaft "Weser", Bremen, Germany

[22] Filed: June 12, 1975

[21] Appl. No.: 586,406

[30] Foreign Application Priority Data

June 14, 1974 Germany ..... 2428794

[52] U.S. Cl. ..... 114/61; 114/66.5 H

[51] Int. Cl.[2] ..... B63B 1/24

[58] Field of Search ..... 114/61, 66.5 H, 66.5 R, 114/66.5 F

[56] References Cited

UNITED STATES PATENTS

| | | | |
|---|---|---|---|
| 3,092,062 | 6/1963 | Sauitsky | 114/66.5 H |
| 3,425,383 | 2/1969 | Scherer | 114/66.5 H |
| 3,447,502 | 6/1969 | Leopold | 114/61 |
| 3,730,123 | 5/1973 | Lang | 114/66.5 H |

FOREIGN PATENTS OR APPLICATIONS

| | | | |
|---|---|---|---|
| 1,296,469 | 5/1962 | France | 114/61 |
| 1,266,163 | 4/1968 | Germany | 114/61 |
| 2,008,502 | 11/1971 | Germany | 114/61 |

*Primary Examiner*—Trygve M. Blix
*Assistant Examiner*—Gregory W. O'Connor
*Attorney, Agent, or Firm*—Michael J. Striker

[57] ABSTRACT

A catamaran vessel has a central longitudinal axis and is provided with a pair of elongated hulls located at opposite sides of its axis and each provided with a bulbous forefoot which is inclined to the longitudinal axis of the vessel. A hydrofoil connects the forefeet and has in a plan view an arrowhead-shaped configuration whose tip may point forwardly or rearwardly with respect to the direction of movement of the vessel.

8 Claims, 9 Drawing Figures

CATAMARAN

BACKGROUND OF THE INVENTION

The present invention relates to a marine vessel, and in particular to a catamaran vessel. More specifically, but not exclusively, the invention relates to a catamaran vessel for high-seas applications for naval and maritime character.

Catamaran vessels are known. They have two separate hulls which are located at opposite lateral sides of the central longitudinal axis of the vessel. The hulls are connected by a structure known as a catamaran bridge. It is also known to provide the hulls of such catamaran vessels with bulbous forefeet whose shape frames are curved eliptically, circularly or in an analogous manner. It contradistinction to single-hull vessels, when bulbous forefeet are used on the hulls of a catamaran vessel the flow direction of water relative to the forefoot of each hull includes an angle with the elongation of the hulls if the hulls or the forefeet themselves are inclined relative to one another and thus with reference to the central longitudinal axis of the vessel, or if they are asymmetrically configurated. The angle of the water flowing towards the rear of the vessel, i.e. the angle included between the flowing water and the central longitudinal axis of the vessel, is influenced by the degree of inclination of the hull or the bulbous forefeet with reference to this axis, or by the degree of asymmetry, by the configuration of the bulbous forefeet, by the position of the bulbous forefeet with reference to the central longitudinal axis of the vessel, and primarily by the waterline configuration of the hulls and their position relative to one another. This is explained in detail in Saunders, Vol. 1, 1957, pages 279 ff.

When the water flows towards the bulbous forefeet at such an angle, for example from the outer lateral side of the hulls inwardly towards the longitudinal central axis of the vessel, it has been observed that at the inwardly facing side of the respective bulbous forefoot the stream of water lifts off the forefoot and that this leads to the formation of substantial eddies, an effect which is strengthened by the fact that at each bulbous forefoot the water flow is separated into an upper flow and a lower flow and that both of these flows form at the location where they lift off the surface of the bulbous forefoot, respective eddies which, coming in part from above and in part from below, merge again at the inwardly facing side (i.e. the side facing towards the central longitudinal axis of the vessel) of the bulbous forefoot, as producing even stronger eddies. There is therefore a very substantial turbulence in the water that passes through the channel defined between the two elongated hulls and this is disadvantageous in terms of the passage of the vessel through the water.

SUMMARY OF THE INVENTION

It is, accordingly, an object of the present invention to provide an improved catamaran vessel wherein the aforementioned disadvantages are avoided.

More particularly, it is an object of the present invention to provide such a catamaran vessel wherein the lifting-off or lifting-away of the water flow which is directed from forward at an angle towards the bulbous forefeet of the hulls of the catamaran vessel, is eliminated.

A further object of the invention is to provide such a catamaran vessel wherein the formation of vertical flows of water along the inwardly facing sides of the bulbous forefeet is avoided.

In keeping with these objects, and with others which will become apparent hereafter, one feature of the invention resides in a catamaran vessel having a central longitudinal axis and comprising a pair of elongated hulls located at opposite sides of this axis. A bulbous forefoot is provided on each of the hulls and inclined to the axis, and a hydrofoil connects the bulbous forefeet of the elongated hulls and has in plan view an arrowhead-shaped configuration.

By constructing the vessel in accordance with the present invention, the longitudinal axes of the bulbous forefeet may be so located as to include with one another an angle whose bisectrix is constituted by the central longitudinal axis of the vessel itself. When the forefeet are so inclined with reference to this central longitudinal axis the oncoming flow of water will be beneficially guided relative to the hulls of the vessel, particularly if the hulls have an asymmetric waterline-shape, whether or not they are themselves so arranged that their own longitudinal axes include an angle with the central longitudinal axis of the vessel itself.

The determination of the waterline configuration and of the aforementioned angles of inclination of the bulbous forefeet with reference to the central longitudinal axis of the catamaran vessel are matters which can be determined readily and without undue experimentation by those having ordinary skill in the art, by conducting towing experiments of a model in a test basin.

The purpose of providing the hydrofoil is to divide the oncoming flow of water so that the flow conditions at the bulbous forefeet are only two-dimensional and the vertical flow causing the eddies is eliminated. Since the hydrofoil can be integrated with the profile of the bulbous forefeet in a hydrodynamically advantageous manner, the inclined oncoming flow of water will no longer lift off the inwardly directed surface of the forefeet, thus avoiding the eddy formation. By making the hydrofoil of arrowhead-shaped configuration, the desired results are more readily attained.

The trailing edges of the hydrofoil, that is those which are trailing as seen with reference to the direction of forward movement of the catamaran vessel, may be provided with guide flaps that are mounted so that they can be adjusted to act as hydroplanes. The hydrofoil is advantageously connected, substantially midway between the hulls, with an upright support that is also connected at its upper end with a catamaran bridge connecting the hulls, so that the hydrofoil is supported. The trailing edge of this upright support may be provided with a movably mounted flap that constitutes a lateral rudder.

The novel features which are considered as characteristic for the invention are set forth in particular in the appended claims. The invention itself, however, both as to its construction and its method of operation, together with additional objects and advantages thereof, will be best understood from the followiing description of specific embodiments when read in connection with the accompanying drawing.

DESCRIPTION OF THE PREFERRED EMBODIMENTS

Figure 1A:
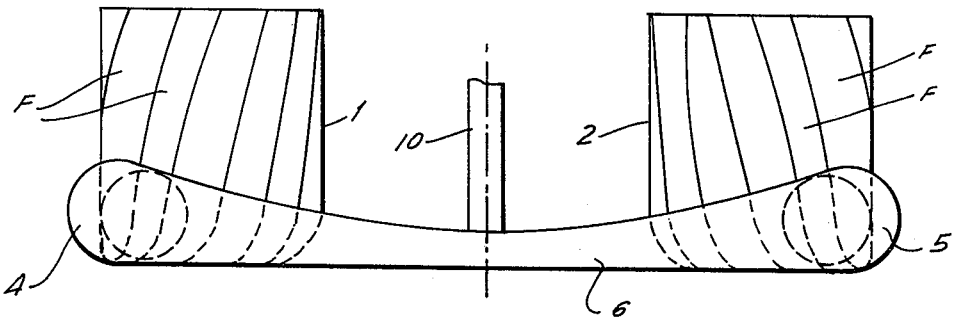
FIG. 1*a* is a front-elevational view of FIG. 1, again with the bridge omitted.
Figure 1:
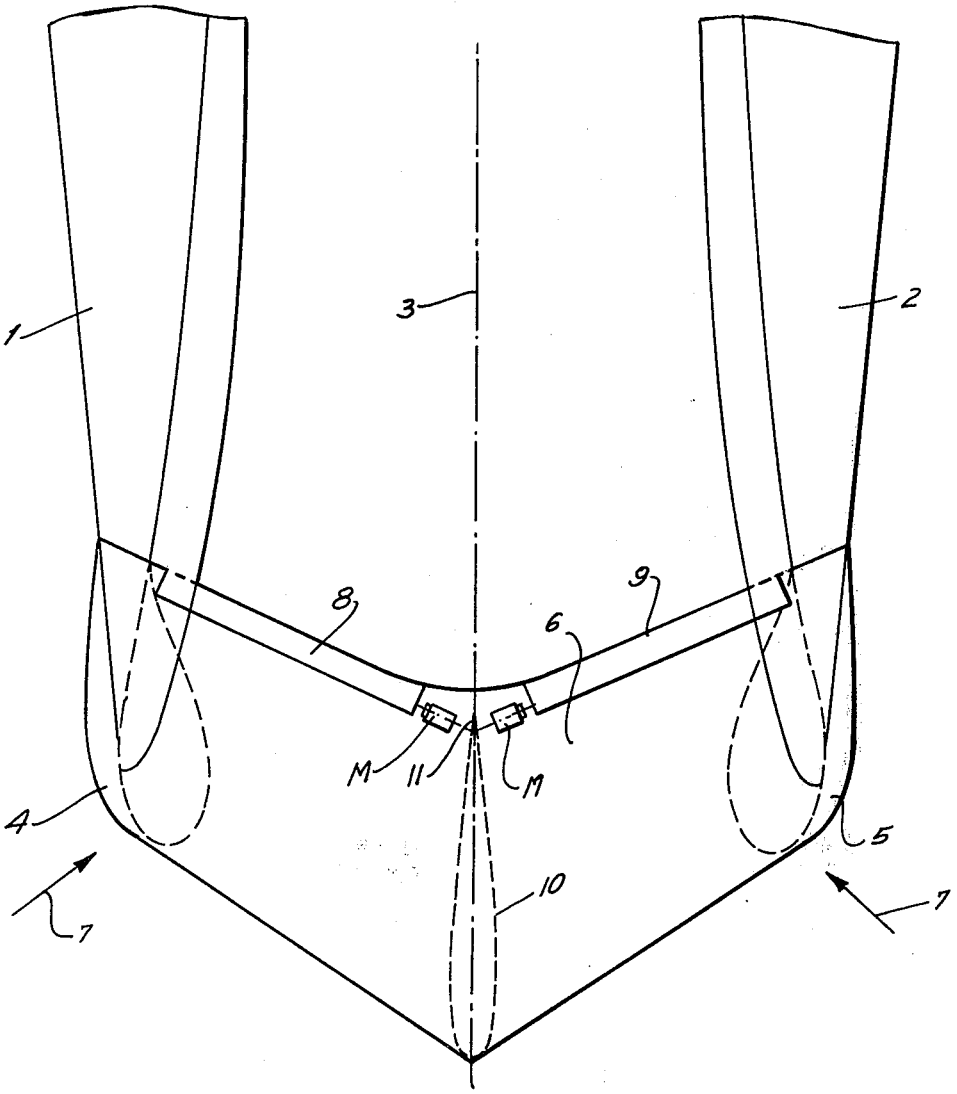
FIG. 1 is a diagrammatic fragmentary top-plan view of a catamaran according to one embodiment of the invention, with the bridge omitted for clarity.
Figure 1B:
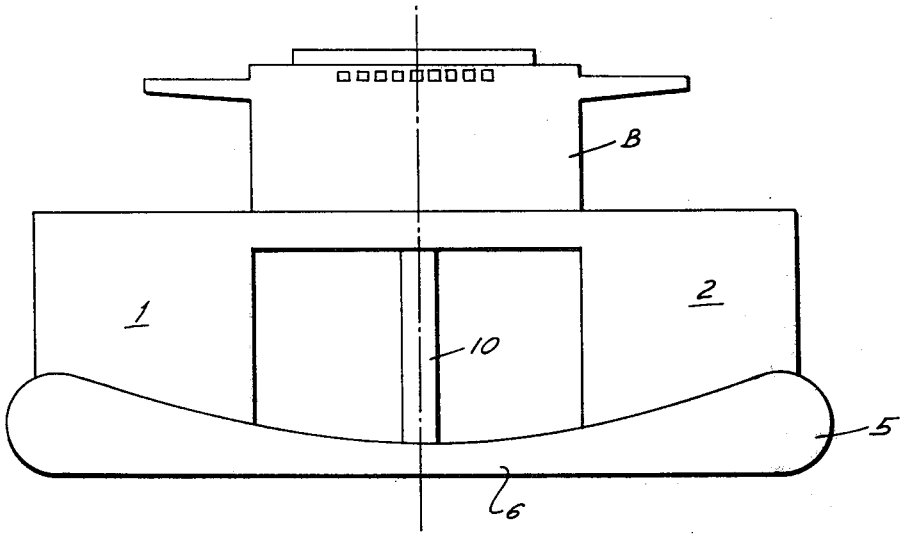
FIG. 1*b* is a front-elevational view of FIG. 1, but illustrating the bridge.

FIGS. 1, 1*a* and 1*b* illustrate one embodiment of the invention. The catamaran vessel in toto has not been specifically illustrated, as a diagrammatic illustration will suffice for an understanding of the invention. Its central longitudinal axis is identified with reference numeral 3 and on opposite lateral sides of this axis 3 there are located two catamaran hulls 1 and 2, respectively. It will be noted that with reference to their own longitudinal axis the hulls 1 and 2 are asymmetrically configurated; they may also be inclined with reference to the longitudinal axis 3 of the vessel. Each of the hulls 1, 2 is provided at its front end with a bulbous forefoot 4 or 5, respectively. The forefeet 4, 5 are elongated and project forwardly of the stem of the respective hull 1, 2. It will be noted that the bulbous forefeet 4, 5 are inclined with reference to the longitudinal axis 3 of the vessel, the flow-dynamically advantageous angle of inclination and configuration of the bulbous forefeet 4, 5 being readily determinable by towing of a test model in a test basin as is conventional in the shipbuilding industry.

According to the invention the forefeet 4, 5 are connected with one another by a hydrofoil 6 which in topplan view has the configuration of an arrowhead (see FIG. 1) whose tip in this embodiment faces forwardly in the direction of movement of the vessel, i.e. as shown in FIG. 1.

Figure 2A:
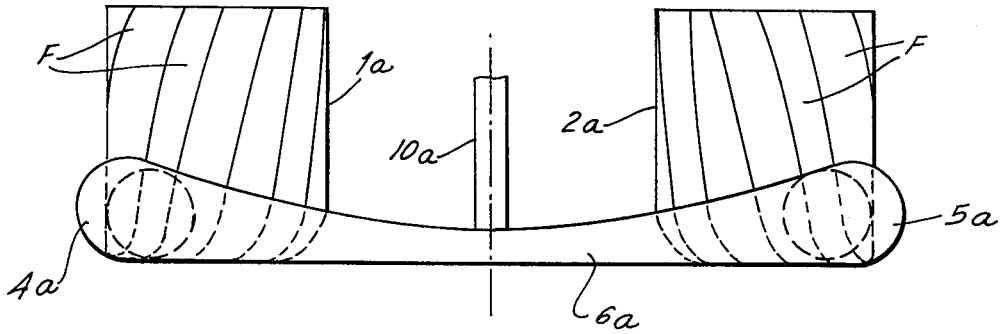
FIG. 2*a* is a view similar to FIG. 1a, but of FIG. 2.
Figure 2:
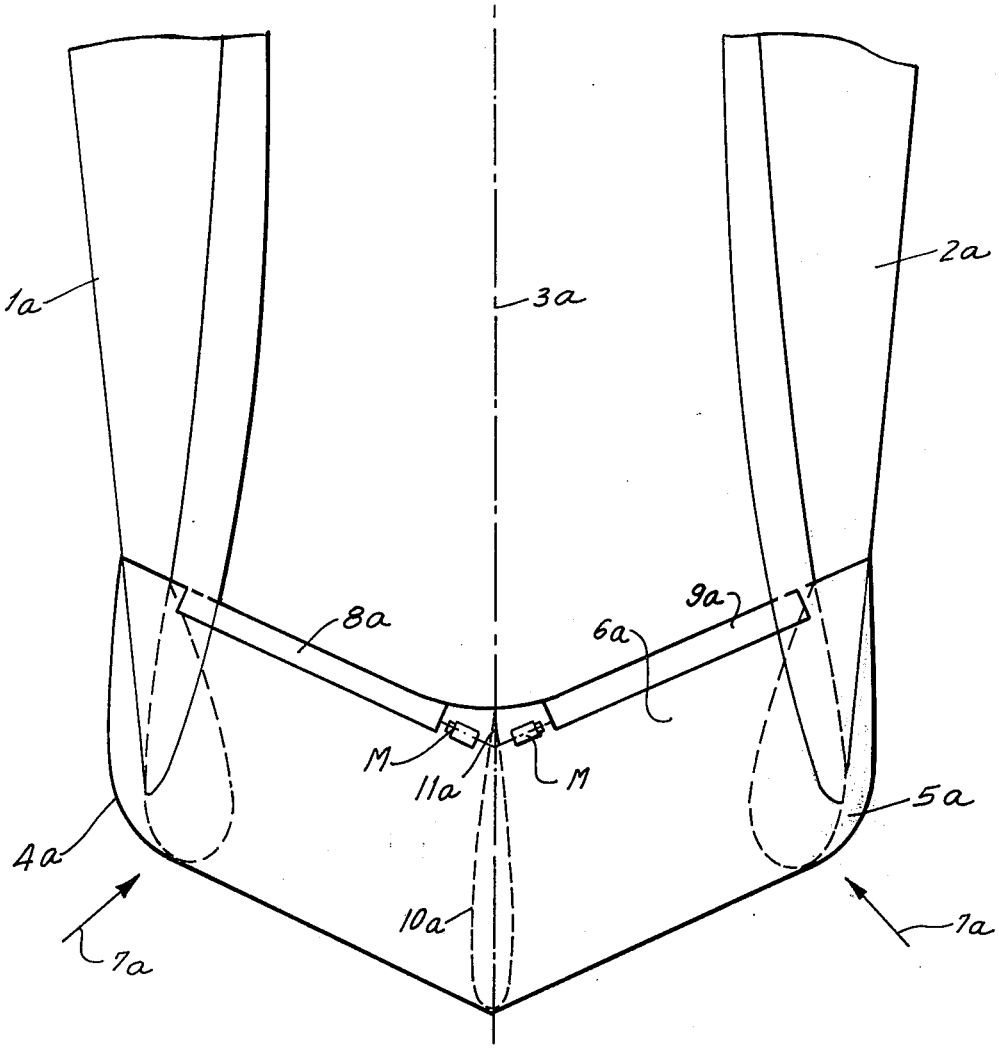
FIG. 2 is a view similar to FIG. 1, but of a different embodiment of the invention.

FIGS. 2 and 2*a*, wherein like reference numerals have been used as in FIGS. 1 and 1a except that they are provided with the suffix *a*, differ from FIGS. 1 and 1*a* only in that the profile of the arrowhead-shaped configuration of the hydrofoil 6a is less pronounced, that is it has a less pronounced tip.

Figure 3A:
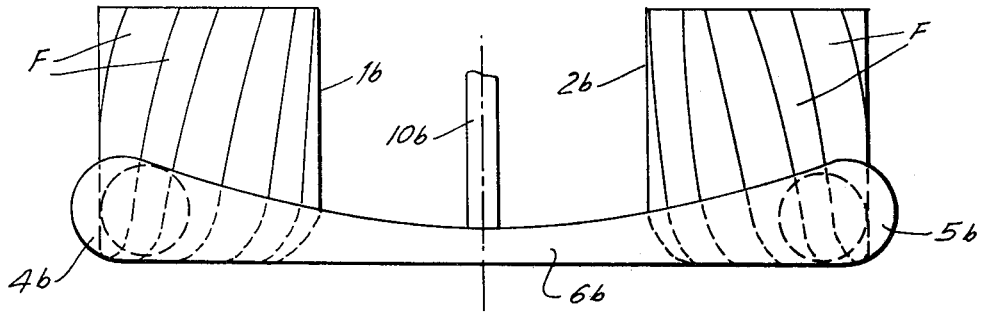
FIG. 3*a* is a view similar to FIG. 2*a*, but of FIG. 3.
Figure 3:
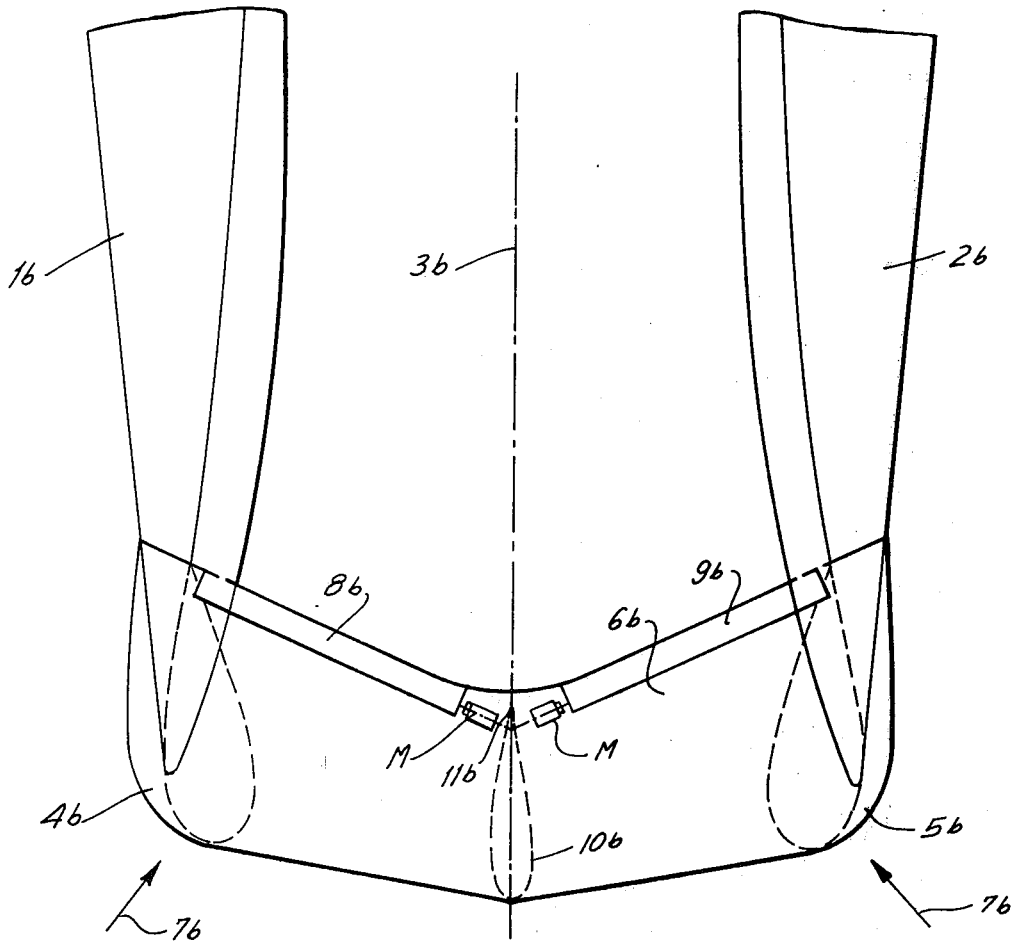
FIG. 3 is a view similar to FIG. 2, but showing a further embodiment of the invention.

FIGS. 3 and 3*a* again use the same reference numerals as in FIGS. 1 and 1*a*, except that the suffix *b* has been employed. These Figures differ from FIGS. 1 and 1*a* only in that the tip of the arrowhead-shaped hydrofoil 6 is even less pronounced.

Figure 4A:
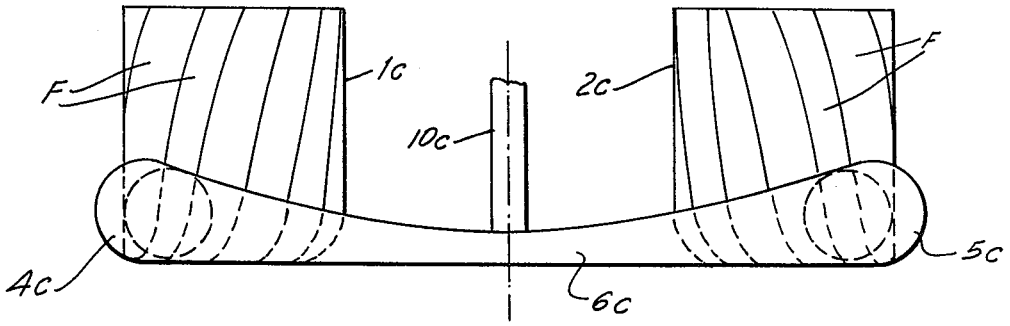
FIG. 4*a* is a view similar to FIG. 3*a*, but of FIG. 4.
Figure 4:
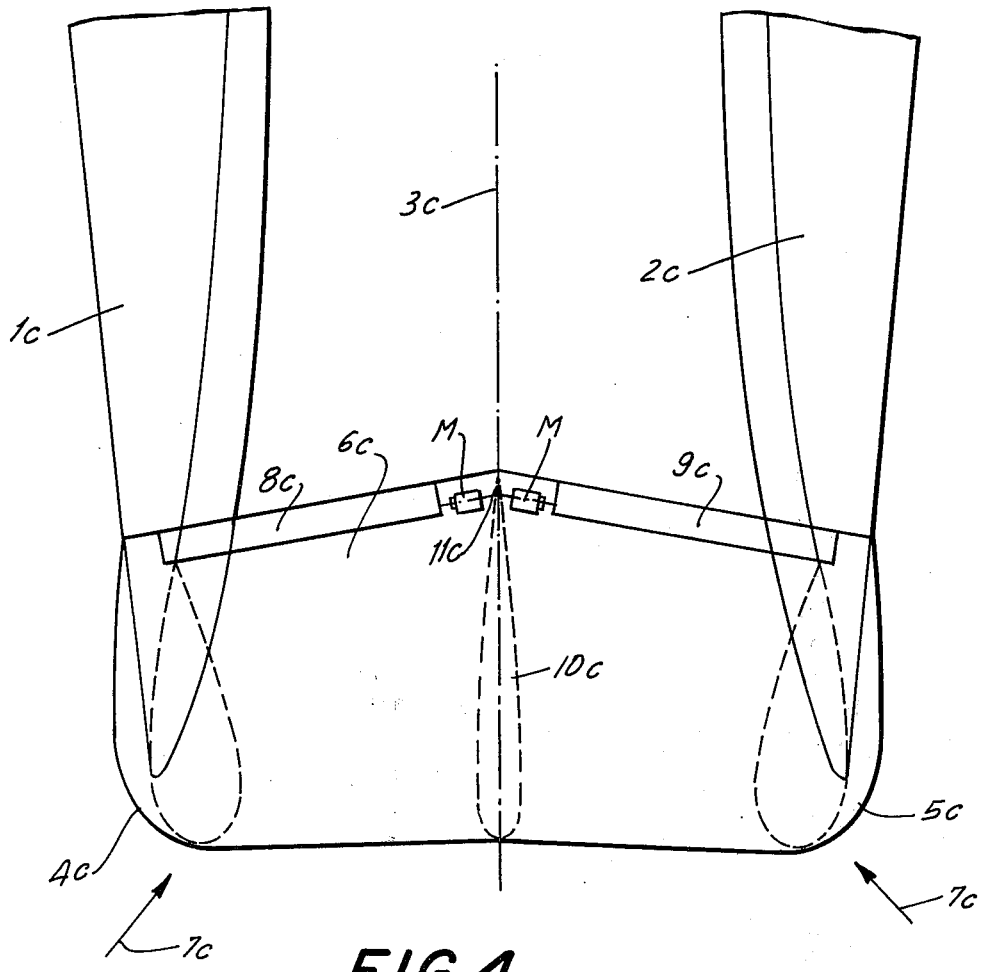
FIG. 4 is a view similar to FIG. 3, but showing still another embodiment of the invention.

FIGS. 4 and 4*a* also use the same reference numerals as FIGS. 1 and 1*a*, except that the suffix *c* has been employed. These Figures differ from FIGS. 1 and 1a in that the tip of the arrowhead-shaped hydrofoil 6*c* faces rearwardly of the direction of movement of the vessel, i.e. rearwardly of the bulbous forefeet 4*c* and 5*c*, respectively.

Returning to FIGS. 1 and 1*a* it will be seen that, as is common to all of the disclosed embodiments, in a vertical plane normal to the axis 3 the thickness of the hydrofoil 6 advantageously decreases in direction from the respective bulbous forefeet 4, 5 towards the central longitudinal axis 3 of vessel. A parallel region can be provided at the center which advantageously merges in a flow dynamically beneficial manner into the bulbous forefeet 4, 5, in order to prevent lifting-off of the water flow at the inwardly facing surfaces of the bulbous forefeet 4, 5, the water flow as it approaches the forefeet 4, 5 being indicated by way of example by the arrows 7 in FIG. 1. In FIG. 1*a* the lines F identify the shape frames of the hulls.

The edge portions of the hydrofoil 6 which are the trailing edge portions as seen with respect to the direction of movement of the vessel are advantageously provided with flaps 8 and 9 which can be raised and lowered to act as hydroplanes. The manner in which such flaps are generally mounted is known in the art, and diagrammatically illustrated motors M can be connected with the flaps 8, 9, for example via reduction gearing, to effect their raising and lowering so that they act as hydroplanes. Substantially midway between the hulls 1, 2 an upright support 10 connects the hydrofoil 6 with the catamaran bridge B (compare FIG. 1*b*) to support and reinforce the hydrofoil 6. Located at the trailing end of the support 10 may be a vertical flap 11 which acts as a lateral rudder, i.e. which can be pivoted about a vertical axis, and which can be pivoted by means of the motors M which again can effect such pivoting via reduction gearing known in the art. Electrical energy for the motors M can be supplied by the propulsion units of the vessel. The use of the rudder 11 in conjunction with the rudders 8, 9 further improves the maneuverability of the vessel.

The motors M may of course control the movement of the flaps 8, 9 and 11 in different ways rather than through reduction gearing, for example via an electrical, hydraulic or pneumatic devices.

It will be understood that each of the elements described above, or two or more together, may also find a useful application in other types of constructions differing from the types described above.

While the invention has been illustrated and described as embodied in a catamaran vessel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A catamaran vessel having a central longitudinal axis, comprising a pair of elongated hulls located at opposite sides of said axis; a bulbous forefoot on each of said hulls and inclined to said axis, each forefoot having an inner side facing said axis at which the flow of oncoming water becomes detached from a respective forefoot and generates undesirable eddy currents; and means for preventing the formation of said eddy currents in the region of said inner sides of said forefeet, comprising a hydrofoil having in plan view an arrowhead-shaped configuration and mounting means for connecting said hydrofoil to said forefeet in the forward region of the vessel so as to prevent water from becoming detached from the forefeet.

2. A catamaran vessel as defined in claim 1, wherein the thickness of said hydrofoil in a vertical plane normal to said axis decreases in direction from the respective forefoot towards said axis.

3. A catamaran vessel as defined in claim 1, said hydrofoil having leading edges and trailing edges with respect to the direction of forward movement of said vessel; and further comprising movable flaps mounted at said trailing edge of said hydrofoil.

4. A catamaran vessel as defined in claim 1; further comprising a catamaran bridge connecting said hulls with one another upwardly of said hydrofoil.

5. A catamaran vessel as defined in claim 4; and an upright support engaging said hydrofoil substantially midway between said hulls and connecting it with said catamaran bridge.

6. A catamaran vessel as defined in claim 5, said upright support having a trailing end; and further comprising a vertical rudder mounted at said trailing end of said upright support.

7. A catamaran vessel as defined in claim 1, wherein said hydrofoil of arrowhead-shaped configuration has a tip which faces forwardly in the direction of movement of said vessel.

8. A catamaran vessel as defined in claim 1, wherein said hydrofoil of arrowhead-shaped configuration has a tip which faces rearwardly, opposite to the direction of movement of said vessel.

* * * * *